US006725007B2

(12) United States Patent
Igarashi

(10) Patent No.: US 6,725,007 B2
(45) Date of Patent: Apr. 20, 2004

(54) DEVELOPING ASSEMBLY AND IMAGE-FORMING APPARATUS

(75) Inventor: Keiko Igarashi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/255,959

(22) Filed: Sep. 27, 2002

(65) Prior Publication Data

US 2003/0068178 A1 Apr. 10, 2003

(30) Foreign Application Priority Data

Oct. 1, 2001 (JP) ..... 2001-305265

(51) Int. Cl.[7] ..... G03G 9/09; G03G 15/09

(52) U.S. Cl. ..... 399/267; 399/276; 430/110.1; 430/111.4; 430/122

(58) Field of Search ..... 399/267, 276, 399/254, 258, 270; 430/122, 120, 110.4, 110.1, 111.1, 111.3, 111.4, 111.41; 29/895; 492/18, 28, 30

(56) References Cited

U.S. PATENT DOCUMENTS 4,866,480 A * 9/1989 Hosoya et al. ..... 399/281
5,005,517 A * 4/1991 Fukui et al. ..... 399/258 X
6,001,525 A * 12/1999 Ida et al. ..... 430/122 X
6,160,979 A * 12/2000 Shoji ..... 399/267
6,178,306 B1 * 1/2001 Mizoguchi et al. ..... 399/276
6,312,862 B1 * 11/2001 Okado et al. ..... 430/111.4 X
6,546,222 B2 * 4/2003 Sakemi et al. ..... 399/276
6,650,858 B2 * 11/2003 Bessho ..... 399/267
2001/0019675 A1 * 9/2001 Masuda et al. ..... 399/267 X
2001/0028987 A1 * 10/2001 Kotsugal et al. ..... 430/111.4 X
2002/0025199 A1 * 2/2002 Hibino ..... 399/267
2002/0028094 A1 * 3/2002 Sakemi et al. ..... 399/276

FOREIGN PATENT DOCUMENTS

JP 05-019632 * 1/1993
JP 5-61238 3/1993
JP 11-84716 3/1999

* cited by examiner

*Primary Examiner*—Sophia S. Chen
(74) *Attorney, Agent, or Firm*—Fitzpatrick, Cella, Harper & Scinto

(57) ABSTRACT

In a developing assembly having a developer container, a developer-carrying member, a developer layer thickness control member, a magnetic-field formation device and an agitation member, the developer is a two-component developer which contains at least a binder resin, a colorant, an organometallic compound and a wax and has wax-dispersed non-magnetic toner particles with an average particle diameter of from 2 $\mu$m to 10 $\mu$m and a magnetic carrier. The developer-carrying member is a member which has been subjected to surface blasting with spherical particles to have a surface having a ten-point average roughness Rz in a range from D/6 to D/2 where D is the average particle diameter of the magnetic carrier. The magnetic carrier has a magnetization intensity in a range of 8 $Am^2/kg$ to 50 $Am^2/kg$ in a magnetic field of 7.95775 kA/m.

14 Claims, 4 Drawing Sheets

DEVELOPING ASSEMBLY AND IMAGE-FORMING APPARATUS

BACKGROUND OF THE INVENTION

1. Field of the Invention

This invention relates to a developing assembly used in image-forming apparatus such as copying machine and laser beam printers making use of an electrophotographic system or electrostatic recording system in which a developer is made to adhere to an electrostatic latent image formed on an image-bearing member, to render it visible. More particularly, it relates to an improvement of a developer-carrying member used to transport the developer.

2. Related Background Art

In forming color images, two-component developers are commonly used which have non-magnetic toner particles and a magnetic carrier. As a developing assembly used in an image-forming apparatus making use of such a known two-component developer, known is as shown in FIG. 2, a developing assembly 9 having a developer container 9*a* which holds therein the developer, a developer-carrying member 3 which is rotatably provided at an opening of the developer container 9*a* and is disposed facing an image-bearing member 4 to hold thereon and transport the developer to a developing zone which is the part where it faces the image-bearing member 4, a developer layer thickness control member 2 which is disposed in a non-contact state with respect to the developer-carrying member 3 to control (regulate) the layer thickness of the developer held on the developer-carrying member 3, a magnetic-field formation means 13 which is stationarily disposed inside the developer-carrying member 3 and by which a magnetic field for drawing up the developer held in the developer container 9*a* and controlling the layer thickness of the developer is formed at the part where it faces the developer layer thickness control member 2, and agitation means 11 and 12 which agitate the developer held in the developer container 9*a*.

The two-component developer held in the developer container 9*a* is so agitated as to circulate reciprocatingly in the developer container 9*a* by the agitation means 11 and 12. Also, the two-component developer held in the developer container 9*a* is drawn up onto the developer-carrying member 3 by the magnetic-field formation means 13 and is transported to an S2 pole, to an N3 pole and to an S1 pole as the developer-carrying member 3 is rotated. In the course of this transport, the developer is controlled against the developer-carrying member 3 by the developer layer thickness control member 2 in the vicinity of the S2 pole, so that a thin layer of the developer is formed on the developer-carrying member 3. This developer rises in ears by the action of the S1 pole and develops the electrostatic latent image on the image-bearing member 4. Thereafter, its portion having not participated in the development falls from the developer-carrying member 3 to the developer container 9*a* by the action of a repulsion magnetic field formed by the N1 pole and N2 pole, and is collected there.

Developers for forming color images (non-magnetic toner particles) are required to have superior transparency of fixed images and various superior properties in respect of low-temperature fixing performance, high-temperature anti-offset properties and so forth. As color toner particles having intended for such attempts, toner particles having a specific storage elasticity are known as disclosed in, e.g., Japanese Patent Application Laid-open No. 11-84716, and toner particles containing a wax are known as disclosed in, e.g., Japanese Patent Application Laid-open No. 5-61238.

Meanwhile, in respect of improvement in the transparency of fixed images and the high-temperature anti-offset properties, techniques which intend to improve them by how to fix images are known in the art. For example, a method is known in which an oil such as silicone oil or fluorine oil is applied on a heat fixing roller. However, fixed images thus obtained have any excess oil adhering to their surfaces. Also, the oil may adhere to the image-bearing member to contaminate it, or the oil may swell the fixing roller to shorten the lifetime of the fixing roller. It is also necessary to feed the oil uniformly and at a constant rate to the surface of the fixing roller so that any oil streaks may not appear on the fixed images. This tends to make the fixing assembly have a large size. Thus, various problems are pointed out in the above method. From such viewpoints, the fixing making use of oils is not preferable in some cases. Accordingly, in order to perform oil-less fixing, toner particles containing a wax may be used. This is advantageous to make up toner particles showing good properties.

As the developer-carrying member in the developing assembly making use of a two-component developer, known is a developer-carrying member the surface of which has been subjected to surface-roughing in order to achieve formation of a uniform developer layer and improvement in transport performance for the developer. As a method of surface-roughing the developer-carrying member surface, amorphous blasting (sand blasting) making use of amorphous particles, having no uniformed shape, is conventionally chiefly carried out in the case of two-component development systems.

The amorphous blasting is a method in which the surface of metal is made to have fine unevenness by spraying at a high speed, sand, alumina particles, silicon oxide particles or the like which have sharp angles and are amorphous. The developer-carrying member surface having been subjected to amorphous blasting is, in its magnified observation, in a rough state that fine grooves are innumerably present. The surface of the developer-carrying member having been subjected to amorphous blasting in this way comes improved in developer transport performance as having been surface-roughed.

However, in color image-forming apparatus and where a two-component developer having non-magnetic toner particles containing a wax is used in a developing assembly having a developer-carrying member having subjected to such amorphous blasting, the following problems are pointed out.

In the conventional developing assembly shown in FIG. 2, the developer having been controlled by the developer layer thickness control member 2 to come left behind is held by the magnetic force of the S2 pole and N2 pole in the vicinity of the upstream side of the developer-carrying member in its rotational direction and gathers there in a large quantity, where the developer is further successively transported as the developer-carrying member 3 is rotated. Hence, a great pressure tends to be applied to the developer on its side upstream to the developer layer thickness control member 2. This tends to cause deterioration of the developer and adhesion of toner particles to magnetic-carrier particle surfaces (what is called "toner-spent phenomenon") as a result of service for a long time. Occurrence of such a phenomenon tends to change the charge quantity (what is called "triboelectricity") of non-magnetic toner particles with service time to cause a change in image density, and images with a very poor impression may come to be formed as the developer is used, compared with images at the initial stage.

The developer containing a wax also commonly tends to cause adhesion of non-magnetic toner particles to the surfaces of the developer-carrying member and magnetic carrier particles, compared with developers not containing any wax, and tends to make the developer have a poor fluidity or cause melt adhesion of toner particles to the developer-carrying member surface (hereinafter also "sleeve contamination"). This tends more remarkably especially in the cases of, e.g., pulverization toner particles on the toner particle surfaces of which the wax tends to be present and toner particles containing the wax in a large quantity.

The developer-carrying member having been subjected to amorphous blasting also has a surface formed in such a surface state that fine grooves are present in a large number. Hence, when such a developer-carrying member is used, the non-magnetic toner particles or any components in the toner particles tend to be caught in dales of the fine unevenness of the developer-carrying member surface to come adhered thereto. The toner particles having adhered to the developer-carrying member surface have a possibility of coming to melt-adhere thereto because of pressure and so forth applied when the layer thickness of the developer is controlled.

In particular, with an increase in the demand for color copying machines or the like in recent years, the copying machines are demanded to achieve a higher image quality and also demanded to have a lower power consumption, in accordance with which the non-magnetic toner particles are made to have a smaller particle diameter and a lower softening point. With such trends, the non-magnetic toner particles or any components in the toner particles more tend to melt-adhere to the uneven area of the developer-carrying member surface as a result of long-term use to come to cause sleeve contamination.

Occurrence of the melt adhesion of toner to the developer-carrying member surface may first make small the quantity in which the developer is transported to the developing zone, to tend to cause a decrease in image density. Also, in conventional cases, in order to perform good development, an alternating electric field (development bias) is often applied to the developer-carrying member at the time of development. In such a case, on occurrence of the melt adhesion of toner to the developer-carrying member surface, a high-resistance layer due to molten deposits may inevitably be formed on the developer-carrying member surface, so that no desired electric field may be formed at the developing zone between the developer-carrying member and the image-bearing member at the time of development. As the result, any sufficient development effect attributable to the development bias cannot be obtained to cause a decrease in image density or cause faulty images such as blank areas.

SUMMARY OF THE INVENTION

An object of the present invention is to provide a developing assembly and an image-forming apparatus which have made it possible, in image formation making use of a two-component developer having non-magnetic toner particles and a magnetic carrier, to weaken the pressure applied to the two-component developer to prevent the non-magnetic toner particles from burying in or melt-adhering to the developer-carrying member surface and prevent the sleeve contamination so that good transport performance for the two-component developer by the developer-carrying member can be maintained and thereby images with good quality can stably be formed over a long period of time.

More specifically, the present invention provides a developing assembly comprising:

i) a developer container which holds therein a developer;

ii) a developer-carrying member which is rotatably provided at an opening of the developer container to hold thereon the developer and transport the developer to a developing zone;

iii) a developer layer thickness control member which is disposed in non-contact with the developer-carrying member to control the layer thickness of the developer held on the developer-carrying member;

iv) a magnetic-field formation means which is enclosed inside the developer-carrying member and disposed stationarily to the developer container and which has magnetic poles for simultaneously a) drawing up the developer from the developer container to the developer-carrying member and b) forming a magnetic field for controlling the layer thickness of the developer on the developer-carrying member at its part where it faces the developer layer thickness control member; and v) an agitation means which agitates the developer held in the developer container;

wherein the developer is a two-component developer which contains wax-dispersed non-magnetic toner particles and a matnetic carrier, the wax-dispersed, non-magnetic toner particles contain at least a binder resin, a colorant, an organometallic compound and a wax, and have an average particle diameter in a range fo 2 $\mu$m to 10 $\mu$m; and the developer-carrying member having been subjected to surface blasting with spherical particles to have a surface having a ten-point average roughness (Rz) of from D/6 to D/2 where D is the average particle diameter of the magnetic carrier.

The present invention also provides an image-forming apparatus making use of the above developing assembly.

According to the above construction, a developing assembly and an image-forming apparatus can be provided which have made it possible, in image formation making use of the two-component developer having non-magnetic toner particles and a magnetic carrier, to weaken the pressure applied to the two-component developer to prevent the wax-dispersed non-magnetic toner particles from burying in or melt-adhering to the developer-carrying member surface and prevent the sleeve contamination so that good transport performance for the two-component developer by the developer-carrying member can be maintained and thereby images with good quality can stably be formed over a long period of time. Thus, the object of the present invention is achieved.

DETAILED DESCRIPTION OF PREFERRED EMBODIMENTS

First, an embodiment of the developing assembly according to the present invention and an embodiment of the image-forming apparatus according to the present invention, having the developing assembly, are described with reference to the accompanying drawings. The present invention is not necessarily limited to the embodiments described below. The image-forming apparatus is described first to show the whole construction, and the developing assembly is described next.

Figure 1:
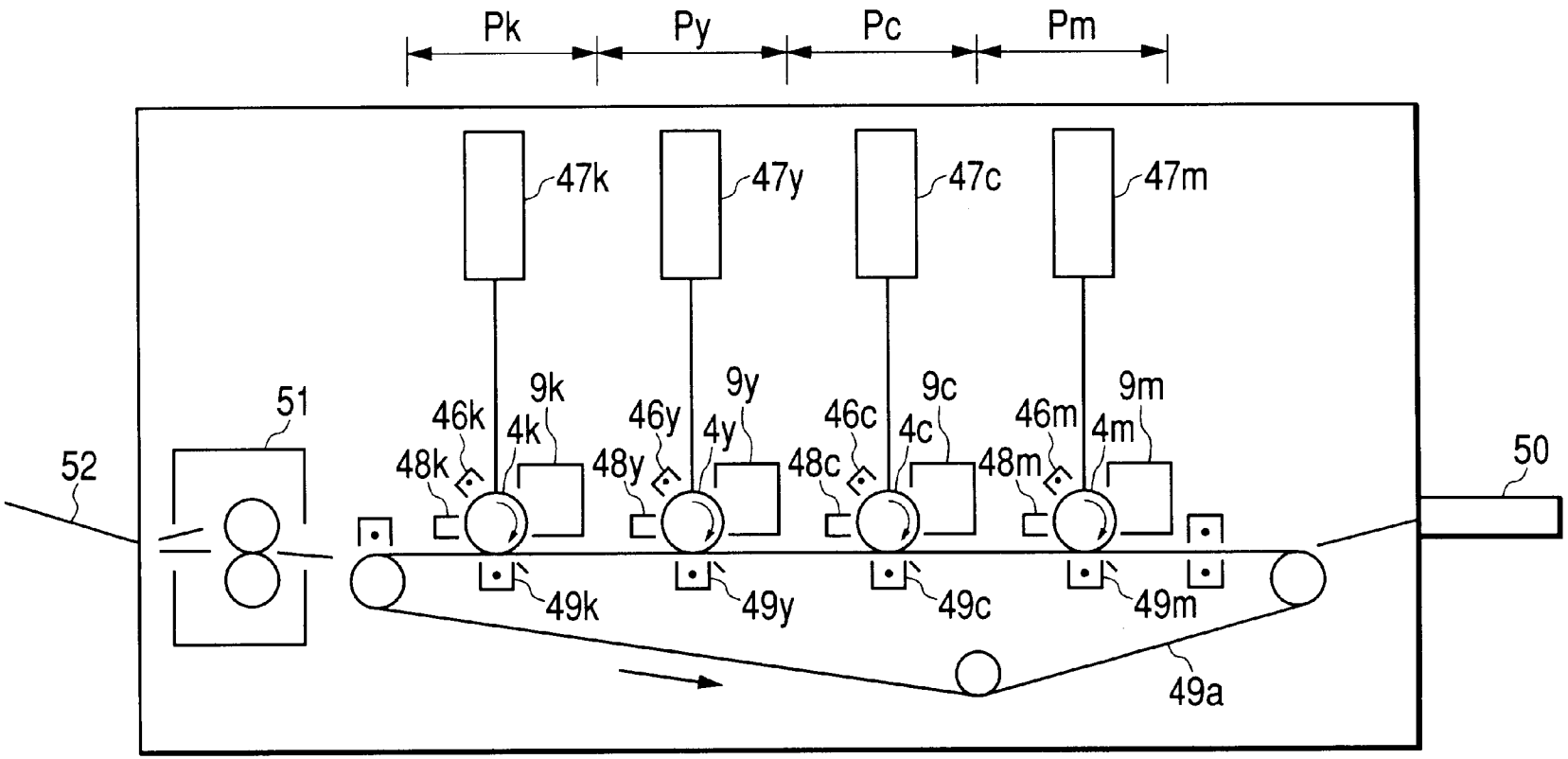
FIG. 1 is a schematic view of the construction of an image-forming apparatus, showing an embodiment in the present invention.

The image-forming apparatus according to an embodiment of the present invention is a four-station laser beam printer having four image-forming stations as shown in FIG. 1. The respective image-forming stations are provided correspondingly to four colors of magenta (m), cyan (c), yellow (y) and black (k). These image-forming stations are means for performing development and transferring the corresponding color toner images. The image-forming apparatus according to this embodiment is an image-forming apparatus of what is called a tandem type, having image-forming stations Pm (magenta), Pc (cyan), Py (yellow) and Pk (black), a transport belt 49*a* by which a transfer material kept in a paper feed tray 50 is transported to transfer positions of the respective image-forming stations, and a fixing assembly 51 with which unfixed toner images held on a transfer material and transported by the transport belt 49*a* are fixed. The transfer material is so transported to the respective image-forming stations that a magenta toner image, a cyan toner image, a yellow toner image and a black toner image are superposed in order. The transfer material having passed the transfer position of the image-forming station Pk is transported to the fixing assembly 51, where the toner images are fixed, and is then delivered to a take-off tray 52.

The respective image-forming stations, though having some differences according to the properties of the respective color developers, are constructed alike. The image-forming stations have image-bearing members 4 (4*m*, 4*c*, 4*y* and 4*k*), charging means 46 (46*m*, 46*c*, 46*y* and 46*k*) which charge the image-bearing members 4 electrostatically, imagewise-exposure means 47 (47*m*, 47*c*, 47*y* and 47*k*) which form electrostatic latent images on the image-bearing members thus charged, developing assemblies 9 (9*m*, 9*c*, 9*y* and 9*k*) by which the electrostatic latent images thus formed are developed with developers, transfer means 49 (49*m*, 49*c*, 49*y* and 49*k*) by which the toner images formed by development are electrostatically transferred from the image-bearing members 4 to the transfer material, and cleaning means 48 (48*m*, 48*c*, 48*y* and 48*k*) for removing transfer residual toners remaining on the image-bearing members 4 after transfer.

The image-bearing members 4 are photosensitive members each having a conductive substrate and a photosensitive layer formed on the conductive substrate; the former being formed in a cylindrical shape using a material such as aluminum or stainless steel and provided rotatably. As the image-bearing members 4, various photosensitive members used usually may be used, as exemplified by OPC (organic photoconductor) photosensitive members or amorphous silicon photosensitive members.

The charging means 46 are corona discharge type charging assemblies which charge the image-bearing members 4 in non-contact. In the present invention, besides such charging means, contact charging means having various charging members conventionally known may be used, as exemplified by charging rollers, charging blades, charging brushes and magnetic brushes.

The imagewise-exposure means 47 are each constituted of a laser light source, a rotary polygon mirror which scans laser light emitted from this laser light source, an fθ lens which converges scanning beams on a generatrix of the developer-carrying member 4 surface, a reflecting mirror which deflects the light beams, and a beam detector which detects specified positions of the scanning beams (all not shown). In the present invention, besides such imagewise-exposure means, various imagewise-exposure means conventionally known may be used, as exemplified by LEDs (light-emitting diodes), in accordance with development systems and the types of image-bearing members.

The transfer means 49 are corona discharge type charging assemblies like those in the charging means 46. In the present invention, besides such transfer means, various transfer means conventionally known may be used, as exemplified by charging rollers and charging blades.

The cleaning means 48 have waste-toner containers which open toward the image-bearing members 4, and cleaning members provided in contact with the image-bearing members 4. As the cleaning members, cleaning blades formed of platelike elastic members such as rubber plates or cleaning rollers having elastic layers formed of elastic materials such as rubber may be used, as conventionally known.

The fixing assembly 51 is a roller type heat-and-pressure fixing assembly having a pair of rollers constituted of a heating roller and a pressure roller, where the transfer material is guided to a nip between both rollers and the toner images are fixed to the transfer material by heat and pressure. In the present invention, besides such a fixing assembly, a film type fixing assembly may also be used in which a film having thermal conductivity and releasability is brought into contact with unfixed images when toner images are fused with a heater to the transfer material.

In the image-forming apparatus according to this embodiment, besides the construction above-described, conventionally known various types of construction may be used, as exemplified by a charging means for separating the transfer material smoothly from the transfer belt, and a pre-exposure means for removing electrostatic history of the image-bearing member after cleaning.

The developing assemblies 9 according to this embodiment are constructed as described below.

Figure 3:
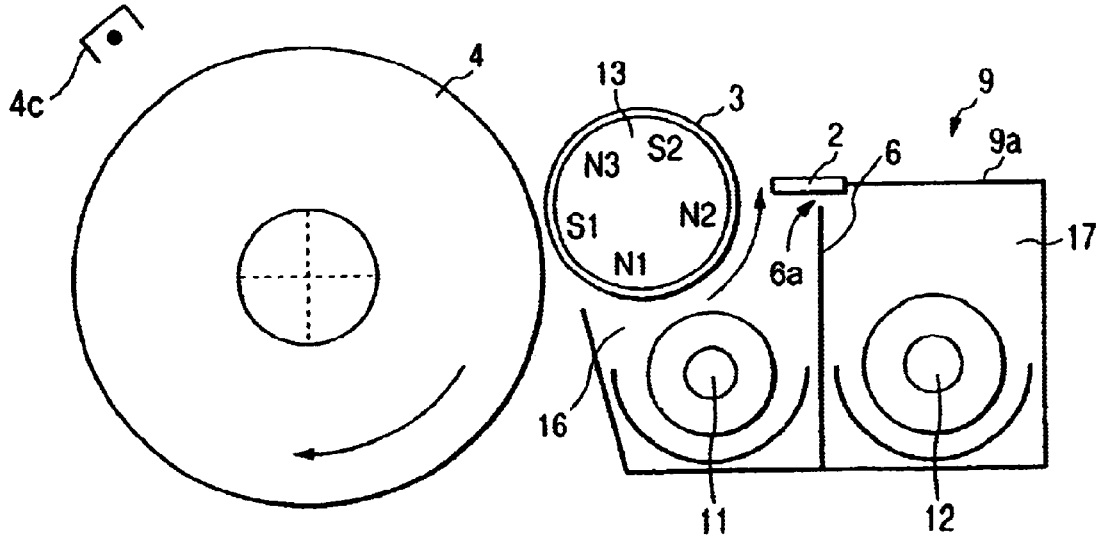
FIG. 3 is a schematic view of the construction of a developing assembly (disposed facing an image-bearing member), showing an embodiment in the present invention.

The developing assemblies 9 according to this embodiment each have, as shown in FIG. 3, a developer container 9*a* which holds therein the developer, a developer-carrying member 3 which is rotatably provided at an opening of the developer container 9*a* and is disposed facing an image-bearing member 4 to hold thereon the developer and transport the developer to a developing zone which is the part where it faces the image-bearing member 4, a developer layer thickness control member 2 which is disposed in non-contact with the developer-carrying member 3 to control the layer thickness of the developer held on the developer-carrying member 3, a magnetic-field formation means 13 which is enclosed inside the developer-carrying member 3 and disposed stationarily to the developer container 9*a* and by which a magnetic field for drawing up the developer from the developer container 9*a* to the developer-carrying member 3 and controlling the layer thickness of the developer on the developer-carrying member 3 is formed at the part where it faces the developer layer thickness control member 2, agitation means 11 and 12 which agitate the developer held in the developer container 9*a*, and an electric-field formation means (not shown) for forming an alternating electric field across the image-bearing member 4 and the developer-carrying member 3. In the developing assembly 9, the developer container 9*a* (preferably an agitation chamber 17) is optionally also provided with a toner storage (supply) chamber (not shown) for supplying fresh non-magnetic toner particles in a quantity corresponding to the non-magnetic toner particles having been consumed in development.

The developer container 9*a* is partitioned with a partition member 6. A developing chamber 16 is formed on the side of the opening of the developer container 9*a*, and the agitation chamber 17 is formed on the inner-part side of the developer container 9*a*. The agitation means 11 and 12 are provided in the chambers 16 and 17, respectively.

In the partition member 6, openings 6*a* are formed on this side and the inner side as viewed from the paper surface in FIG. 3. Also, the direction of developer transport (the direction of agitation) by the agitation means 12 provided in the agitation chamber 17 is set opposite to the direction of developer transport (the direction of agitation) by the agitation means 11 provided in the developing chamber 16. The developer in the agitation chamber 17 is fed to the developing chamber 16 through one of the openings 6*a* of the partition member 6 by the agitation means 12. The developer in the developing chamber 16 is fed back to the agitation chamber 17 through the other of the openings 6*a* of the partition member 6 by the agitation means 11. Thus, the developer container 9*a* and the agitation means 11 and 12 are so constructed that the two-component developer is agitated in the respective chambers and also the two-component developer held in the developer container 9*a* is circulatively transported to the respective chambers so as to be made uniform.

There are no particular limitations on the agitation means 11 and 12 as long as they are means by which the two-component developer can be agitated and transported in the whole region of the developer container 9*a* in the lengthwise direction of the developer-carrying member 3. Various means used usually may be used, as exemplified by rotating blades and screws.

The two-component developer held in the developing chamber 16 is fed toward the developer-carrying member 3 along the whole region in the lengthwise direction of the developer-carrying member 3 by the agitation means 11, and is held on the developer-carrying member 3 upon attraction of the magnetic carrier to the N2 pole of the magnetic-field formation means 13. Then, the two-component developer is drawn up by the action of the N2 pole and at the same time its layer thickness is controlled by the developer layer thickness control member 2. The two-component developer having been controlled to have a proper layer thickness uniformly forms on the developer-carrying member 3 a magnetic brush attributable to the magnetic carrier, and reaches a magnetic field formed by the S1 pole facing the developing zone, so that the magnetic brush comes into contact with the image-bearing member 4 in that magnetic field. Meanwhile, from the above-described electric-field formation means 4*c*, the development bias is applied in order to form the alternating electric field across the image-bearing member 4 and the developer-carrying member 3. Through these means, the wax-dispersed non-magnetic toner particles moves to the image-bearing member 4 in accordance with the electrostatic latent image to develop the electrostatic latent image.

The two-component developer (chiefly the magnetic carrier) on the developer carrying member 3 having passed the developing zone is transported again into the developing chamber 16 as the developer-carrying member 3 is rotated, and falls in the developing chamber 16 from the surface of the developer-carrying member 3 by repulsion magnetic field formed by N1 pole and N2 pole. The two-component developer having fallen in the developing chamber 16 is agitated and transported by the agitation means 11. It is also supplied with fresh-wax-dispersed non-magnetic toner particles from the toner supply chamber as described above, is made uniform by the circulation as described above, and comes to the state it is held in the developer container 9*a* as a two-component developer having a proper concentration. The standing, uniform two-component developer is transported by the agitation means 11 in the developing chamber 16, and the above development process is repeated.

The quantity of the wax-dispersed non-magnetic toner particles to be supplied from the toner supply chamber may be determined on the basis of, e.g., i) an estimated quantity of wax-dispersed non-magnetic toner particles at the time of development, calculated from the information of images to be formed as electrostatic latent images, or ii) measurement results calculated from the image density of images having been formed.

In the present invention, the developing assembly also has the developer layer thickness control member which is disposed in non-contact with the developer-carrying member, and the magnetic-field formation means which is enclosed inside the developer-carrying member and disposed stationarily to the developer container and which has magnetic poles for simultaneously drawing up the developer from the developer container to the developer-carrying member and forming a magnetic field for controlling the layer thickness of the developer on the developer-carrying member at its part where it faces the developer layer thickness control member. Hence, it is possible to weaken the pressure applied to the two-component developer before layer thickness control to prevent the wax-dispersed non-magnetic toner particles from deforming or melt-adhering.

Figure 2:
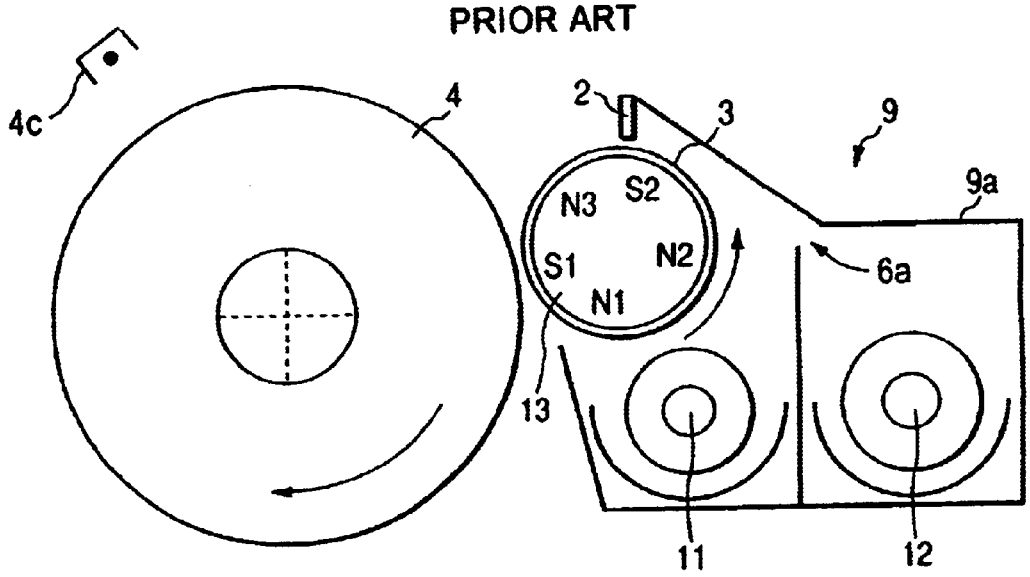
FIG. 2 PRIOR ART
FIG. 2 is a schematic view showing an example of the construction of a developing assembly (disposed facing an image-bearing member) in the related background art.

More specifically, the developing assembly is so constructed that the magnetic field formed by the N2 pole and the concentrated magnetic field formed across the N2 pole and the developer layer thickness control member act to hold the developer on the developer-carrying member in the vicinity of the developer layer thickness control member. Hence, the force by which the developer is bound onto the developer-carrying member on its side upstream to the developer layer thickness control member can be weaker than that in the construction as shown in FIG. 2 in the related background art, and the developer having gathered on the side upstream to the developer layer thickness control member can fall with ease, and hence the force applied to the two-component developer can be weakened.

In the present invention, it is also preferable that the developer layer thickness control member 2 is provided substantially horizontally at the opening of the developer container 9*a* and also provided substantially along the generatrix direction in a cross section of the developer-carrying member. Thus, the developer gathering on the side upstream to the developer layer thickness control member 2 can directly fall with ease to the developing chamber 16. This is more effective in order to weaken the pressure applied to the developer.

Figure 6:
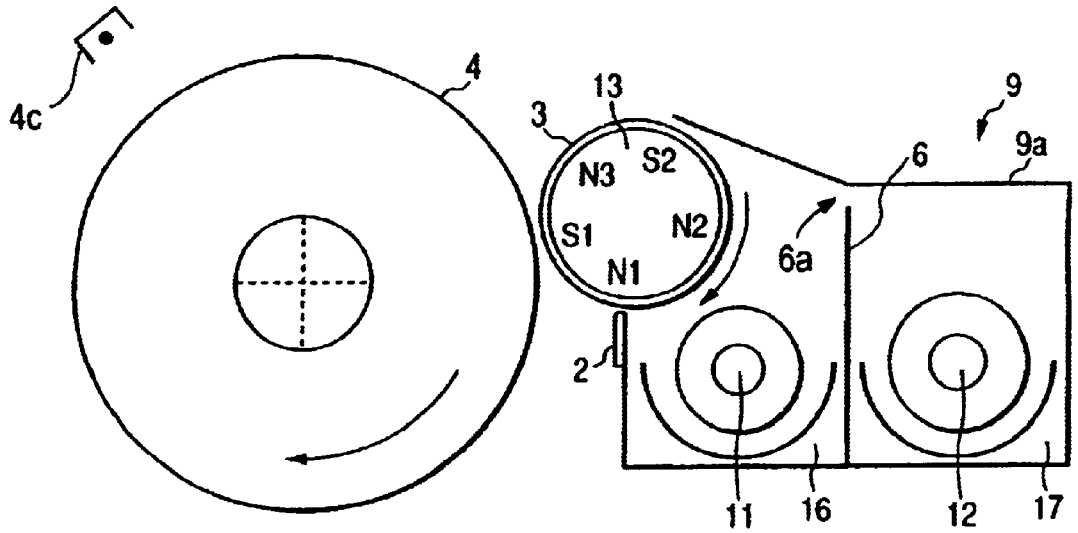
FIG. 6 is a schematic view of the construction of a developing assembly (disposed facing an image-bearing member), showing another embodiment in the present invention.

A developing assembly as shown in FIG. 6 may also be used. This developing assembly differs from the developing assembly shown in FIG. 3 in that the developer-carrying member is rotated in the opposite direction and that the developer layer thickness control member 2 is provided along the lower edge of the opening of the developer container 9*a* so that the layer thickness of the developer on the developer-carrying member 3 can be controlled at its surface being about to come out of the inside of the developer container 9*a*. The developing assembly constructed in this way is effective when it is necessary to use a high-resistance magnetic carrier, e.g., when an amorphous silicon photosensitive member is used as the image-bearing member.

Such a high-resistance carrier refers to a magnetic carrier having a resistivity of from $10^{12}$ to $10^{15}$ Ω·cm. The use of this high-resistance carrier tends to cause abnormal images called blank areas when an image with a low density and an image with a high density are formed in this order in the direction of movement of the image-bearing member; the blank areas appearing on the downstream side of the low-density side at the part where a difference in density of such images appears. Also when a low-density area follows a high-density area continuously, a problem of what is called sweep-up has tended to occur, which is a phenomenon that the rear end of the high-density area comes further high-density. Such a problem can be solved by rotatingly driving the image-bearing member 4 and the developer-carrying member 3 in such directions that the surfaces of the both members move in the opposite directions (counter directions) at the developing zone.

Meanwhile, where a high-magnetization magnetic carrier is further used in the above construction, ear-mark images called brush marks (scavenging) tend to occur. If, however, a low-magnetization magnetic carrier (having a magnetization intensity of 8 to 50 $Am^2/kg$ in a magnetic field of 7.95775 kA/m) is used in order to solve such a problem, the transport performance for the developer tends to lower.

More specifically, where all the above construction is employed, a lowering of transport performance for the developer remains as a chief problem. However, the use of the developer-carrying member with the conditions specified in the present invention and the use of the developing assembly constructed as described above enable utilization of the high-resistance and low-magnetization magnetic carrier while maintaining good transport performance for the developer.

To describe the behavior of the two-component developer in the above FIG. 6 developing assembly, the developer attracted by the N1 pole is coated on the developer-carrying member 3 by the rotation of the developer-carrying member 3. The developer coated on the developer-carrying member 3 passes through the developer layer thickness control member 2 and is controlled to have a proper developer layer thickness, and then it reaches the developing magnetic pole S1, where the developer having risen in ears in its magnetic field develops the electrostatic latent image held on the image-bearing member 4. Thereafter, it is transported to the N3 pole, to the S2 pole and to the N2 pole, and the developer held on the developer-carrying member 3 falls in the developing chamber 16 with ease by the action of a repulsion magnetic field formed by the N2 pole and the N1 pole. The developer having fallen in the developing chamber 16 is agitated and transported by the agitation means 11 and 12. The above development process is repeated. In the developing assembly shown in FIG. 6, too, it is so constructed that the developer falls with ease on the side upstream to the developer layer thickness control member 2. Thus, the pressure applied to the developer can be lessened.

The developer-carrying member 3 usable in the present invention is a cylindrical sleeve formed of a non-magnetic conductive material such as aluminum or stainless steel. The developer-carrying member 3 has been subjected to surface blasting with spherical particles so that it has been surface-roughed to have a surface having a ten-point average roughness (Rz) of from D/6 to D/2 where D is the average particle diameter of the magnetic carrier. Adjustment of the ten-point average roughness to a value within such a range enables prevention of the melt adhesion of toner to the developer-carrying member 3 surface and also enables maintenance of good transport performance for the developer. Here, the ten-point average roughness refers to ten-point average roughness (Rz) according to JIS B0601, and qualitatively represents a difference in height and depth between hills and dales of the unevenness.

If the surface has a ten-point average roughness smaller than D/6, the unevenness formed at the surface of the developer-carrying member 3 is so fine that the wax-dispersed non-magnetic toner particles may adhere to the surface to tend to cause the melt adhesion of toner. If the surface has a ten-point average roughness larger than D/2, edges corresponding to hills of the unevenness formed at the surface come very sharp and also may affect the formation of ears of the developer at the time of development to consequently affect images in some cases.

Figure 7:
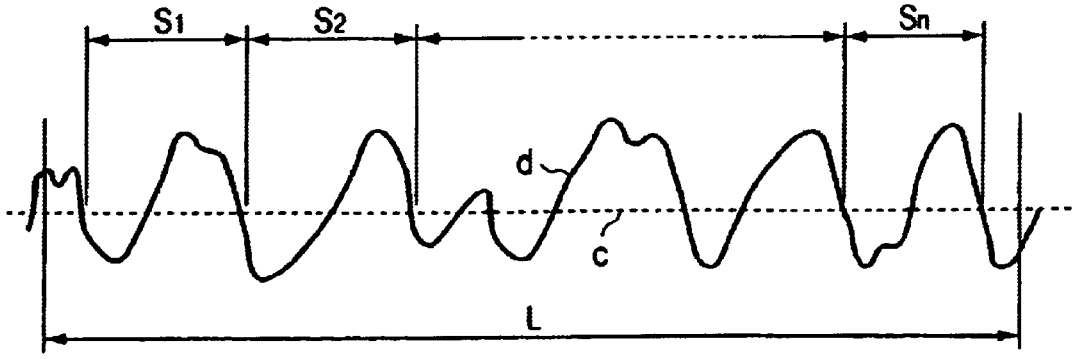
FIG. 7 is a view for describing the definition of average hill-to-hill intervals.

The ten-point average roughness (Rz) refers to one in which, at a part cut off by the standard length (measurement length) L from the profile curve D of the surface having been surface-roughed as shown in FIG. 7, the value of a difference between the average value of elevations of the tops of from the highest hill to the fifth hill and the average value of elevations of the bottoms of from the deepest dale to the fifth dale is represented in micrometer (μm).

The developer-carrying member 3 may also preferably have a surface having an average hill-to-hill interval (Sm) of from D/3 to 6D, and more preferably from D/2 to 3D, where D is the average particle diameter of the magnetic carrier. The melt adhesion of toner occurs when toner particles come into fine dales and, as a result that this state is maintained over a long period time, they come pressed against the dales by the magnetic carrier. However, as long as the surface has the average hill-to-hill interval within the above range, the contact performance of the wax-dispersed non-magnetic toner particles with the magnetic carrier can be maintained and also the good transport performance for the developer can be maintained. If the average hill-to-hill interval is smaller than the above range, the melt adhesion of toner tends to occur. If it is larger than the above range, the transport performance for the developer tends to lower.

Here, the average hill-to-hill interval is one in which, at a part cut off by the standard length (measurement length) L from the profile curve D of the surface having been surface-roughed as shown in FIG. 7, the interval between the cross point at which the profile curve extending from the first hill to the first dale crosses its center line C and the cross point at which the profile curve extending from the next hill to the next dale crosses its center line is represented by $S_1$, and the intervals between the cross points subsequent thereto are represented by $S_2$, $S_3$ and so forth up to Sn (n represents the total number of the hill-to-dale cross points in the standard length), where their arithmetic mean is found. It is expressed by the following equation.

$$\text{Average hill-to-hill interval } (S_m)=(S_1+S_2+\ldots+S_n)/n$$

where n represents the total number of the hill-to-dale cross points in the standard length.

Figure 4:
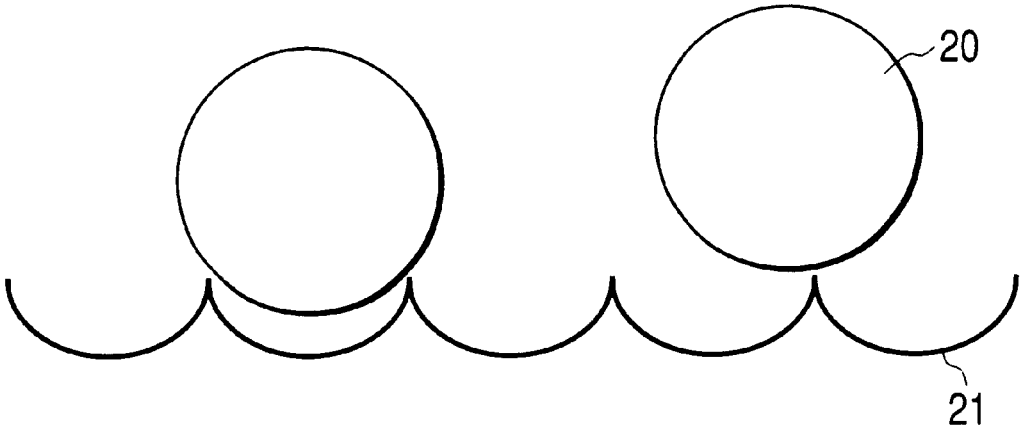
FIG. 4 is an enlarged view of a surface profile in an example of the developer-carrying member used in the present invention.
Figure 5:
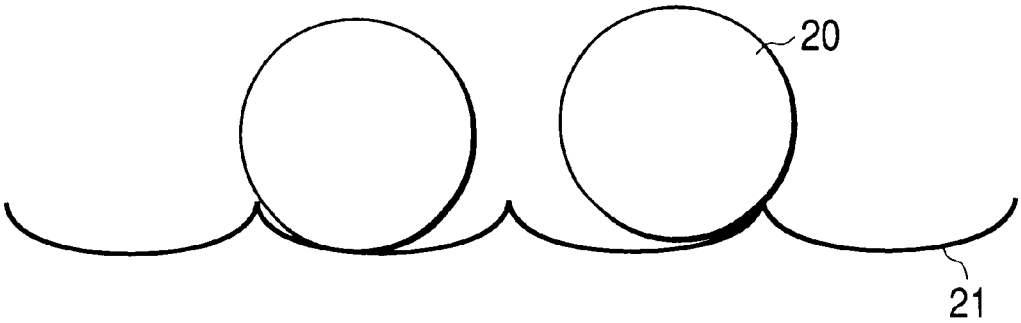
FIG. 5 is an enlarged view of a surface profile in another example of the developer-carrying member used in the present invention.

The blasting of the developer-carrying member surface is carried out using spherical particles as abrasive particles. Where the blasting is thus carried out using spherical particles as abrasive particles, unevenness having dales which are arc-like in sectional shape as shown in FIG. 4 or 5 are formed at the surface of the developer-carrying member. The difference in height and depth between hills and dales of this unevenness is specified as described above. Thus, even when the wax-dispersed non-magnetic toner particles are stuck in these dales, the magnetic carrier comes into contact with the wax-dispersed non-magnetic toner particles thus stuck therein and again carries them with ease, so that the good transport performance for the developer and the prevention of the melt adhesion of toner can be achieved. Here, the blasting may be carried out by a conventional method in which the abrasive particles are led into air streams and these are sprayed against a non-magnetic cylindrical member which is to serve as the developer-carrying member.

The spherical particles used in the above blasting is herein meant to be abrasive particles whose particle shape has been regulated in a spherical form or in substantially a spherical form. Such spherical particles may be exemplified by glass beads, stainless-steel balls, ceramic balls, steel balls and ferrite balls. Non-magnetic spherical particles may preferably be used in accordance with materials and so forth of the developer-carrying member. As specific examples, commercially available products may be used in the spherical particles used in the present invention, and such spherical particles may be exemplified by FGB (Fuji Glass Beads) #100 to #600.

The spherical particles may preferably have an average particle diameter of from 1D to 10D where D is the average particle diameter of the magnetic carrier. Spherical particles having an average particle diameter smaller than the above range are undesirable because the wax-dispersed non-magnetic toner particles having stuck in the dales of the unevenness formed at the developer-carrying member surface may be collected with difficulty by the magnetic carrier, and also undesirable from the viewpoint of the transport performance for the developer because the magnetic carrier does not come to come into the dales. Also, spherical particles having an average particle diameter larger than the above range may cause unevenness in the developer layer formed on the developer-carrying member, to affect images.

The surface-roughing of the developer-carrying member can be achieved by appropriate selection of the abrasive particles to be used. There are no particular limitations on the step of surface-roughing inclusive of blasting. It is preferable for the surface to be roughed by blasting with the spherical particles after the surface has been polished by diamond polishing. Also, it is preferable for the developer-carrying member to have been surface-treated by electroless plating after its surface has been roughed by blasting with the spherical particles.

The developer layer thickness control member 2 is a blade member formed of a magnetic material, and is a member which causes the magnetic field to concentrate to the tip facing in its sectional shape the developer-carrying member 3, to control the layer thickness of the developer on the developer-carrying member 3. In the present invention, a non-contact control member may preferably be used. With regard to the strength of the magnetic field, it may be adjusted by changing the distance between the control member 2 and the developer-carrying member 3 and changing the shape of the tip of the developer layer thickness control member 2 (e.g., making its sectional shape into a tapered shape so as to make the magnetic field more concentrated).

The magnetic-field formation means 13 is a roll-shaped magnet having a plurality of magnetic poles. As shown in FIG. 3, the N2 pole is disposed at the position facing the developer layer thickness control member 2, and subsequently the S2 pole, the N3 pole, the S1 pole and the N1 pole are disposed along the rotational direction of the developer-carrying member 3. In the present invention, besides such a magnet as the magnetic-field formation means, a magnetic-field formation means such as an electromagnet capable of forming any desired magnetic field at will may be used.

The two-component developer used in the present invention is described below. The developer is a two-component developer which contains wax-dispersed non-magnetic toner particles and a magnetic carrier, the wax-dispersed, non-magnetic toner particles contain at least a binder resin, a colorant, an organometallic compound and a wax, and have an average particle diameter in a range of 2 $\mu$m to 10 $\mu$m. Here the wax-dispersed non-magnetic toner particles refer to those in which the wax contained in toner particles is present standing dispersed in the interiors of the whole toner particles.

The wax-dispersed non-magnetic toner particles have an average particle diameter of from 2 $\mu$m to 10 $\mu$m, and preferably from 6 $\mu$m to 9 $\mu$m. Those having an average particle diameter smaller than the above range tend to cause faulty charging and any difficulties due to acceleration of the melt adhesion of toner. Those having an average particle diameter larger than the above range tend to lower image reproducibility. The average particle diameter of the wax-dispersed non-magnetic toner particles may be adjusted by classifying a crude product in the course of production.

There are no particular limitations on the wax-dispersed non-magnetic toner particles as long as they contain the above materials and the above average particle diameter. There are no particular limitations also on their production process. The production process may be selected in accordance with materials used, required physical properties and so forth. In the present invention, its advantageous effect can be brought out also when toner particles are used which have been produced by a pulverization process in which toner particles on the surfaces of which the wax is present in a larger quantity tend to be formed. Accordingly, as the wax-dispersed non-magnetic toner particles, non-magnetic toner particles produced by pulverization may be used as preferred toner particles.

As the binder resin contained in the wax-dispersed non-magnetic toner particles, any of conventionally known various resins may be used. One or two or more kinds of resins may be used in accordance with charge characteristics, fixing characteristics such as low-temperature fixing performance and anti-offset properties and so forth of the wax-dispersed non-magnetic toner particles. Such resins may more specifically be exemplified by styrene resins, acrylic or methacrylic resins and styrene-acrylic or -methacrylic copolymer polyester resins.

As the colorant contained in the wax-dispersed non-magnetic toner particles, any of conventionally known non-magnetic colorants may be used. Such colorants may include known dyes and pigments, and carbon black.

The organometallic compound contained in the wax-dispersed non-magnetic toner particles is a charge control agent, and any of organometallic compounds conventionally known as charge control agents, including, e.g., azo type metal complexes, and metal compounds of aromatic dicarboxylic acids or aromatic oxycarboxylic acids. Particularly preferred is an azo type iron complex or a di-tert-butylsalicylic acid aluminum compound.

The wax contained in the wax-dispersed non-magnetic toner particles is mixed in order to improve characteristics such as low-temperature fixing performance, anti-offset properties and fixing transparency. As such a wax, various waxes are conventionally known. For example, paraffin waxes, purified normal paraffin waxes, ester waxes, paraffin, polyethylene, polypropylene, derivatives of these and mixture of any of these.

Besides these, in the wax-dispersed non-magnetic toner particles, various additives may be mixed in order to improve characteristics of the non-magnetic toner particles.

The magnetic carrier may preferably have an average particle diameter of from 30 $\mu$m to 80 $\mu$m. If the magnetic carrier has an average particle diameter smaller than the above range, it tends to become unable to carry the wax-dispersed non-magnetic toner particles sufficiently. If it has an average particle diameter larger than the above range, the magnetic carrier tends to be insufficiently held on the developer-carrying member. The average particle diameter of the magnetic carrier may also be adjusted by classification.

Various forms are known as magnetic carriers, such as a magnetic material itself, those in which the particle surfaces of a magnetic material are coated with a resin, and those in which fine particles of a magnetic material have been dispersed in a resin. In the present invention, those in which the particle surfaces of a magnetic material are coated with a resin are preferred because they show sufficient magnetization intensity and resistance and also these characteristics can be controlled relatively with ease.

As the magnetic material, any known material may be used, as exemplified by metals such as iron, nickel, copper, zinc, cobalt, manganese, chromium and rare earth elements, which may be surface-oxidized or unoxidized, alloys or oxides of any of these, and ferrite. A preferred material may include ferrite particles. Also, as the resin with which the magnetic material is coated, any known resin may be used. For example, the binder resins described above and silicone resins are preferred. A nitrogen-containing silicone resin or a modified silicone resin formed by the reaction of a nitrogen-containing silane coupling agent with a silicone resin may also be used.

The magnetic carrier may also preferably have a magnetization intensity of from 8 to 50 $Am^2/kg$ in a magnetic field of 7.95775 kA/m (1 kilo-oersteds). If the magnetic carrier has a magnetization intensity lower than the above range in that magnetic field, it may insufficiently be held on the developer-carrying member. If it has a magnetization intensity higher than the above range, the two-component developer on the developer-carrying member may have an insufficient fluidity, resulting in insufficient triboelectric charging of the wax-dispersed non-magnetic toner particles in some cases. The magnetization intensity may be adjusted by selecting the type of the magnetic material or by subjecting the magnetic material to oxidation treatment.

The magnetic carrier may also preferably have a resistivity of from $10^7$ to $10^{15}$ $\Omega\cdot$cm. If the magnetic carrier has a resistivity lower than the above range, injection of electric charges and carrier adhesion tend to occur to electrostatic latent images at the time of development. If it has a resistivity higher than the above range, difficulties due to the direction of electric field, such as blank areas and sweep-up, may tend to occur at density shift areas of electrostatic latent images (latent images of images having large differences in density).

In addition to the wax-dispersed non-magnetic toner particles and magnetic carrier described above, the two-component developer used in the present invention may further contain, e,g, an inorganic fine powder for improving the fluidity of the two-component developer, such as silica, alumina or titanium oxide and a conductive fine powder for regulating the charge characteristics of the two-component developer.

As can be seen from the foregoing description, in the present embodiment, the developer-carrying member having been subjected to surface blasting with spherical particles to have a ten-point average roughness (Rz) of from D/6 to D/2 where D is the average particle diameter of the magnetic carrier is used in the developing assembly making use of the two-component developer, and hence the wax-dispersed non-magnetic toner particles can be prevented from burying in the developer-carrying member surface, the melt adhesion of toner which may occur when the wax-dispersed non-magnetic toner particles gather in the dales of the unevenness of the developer-carrying member surface over a long period of time and the sleeve contamination which may be caused by it can be prevented, and also the good transport performance for the two-component developer can be maintained.

According to the developing assembly and image-forming apparatus in this embodiment, in the image formation making use of the two-component developer having the wax-dispersed non-magnetic toner particles and the magnetic carrier, the pressure applied to the two-component developer can be weakened to prevent the wax-dispersed non-magnetic toner particles from burying in the developer-carrying member surface, any sleeve contamination due to the melt adhesion of toner does not occur, and the two-component developer's good transport performance that is attributable to the developer-carrying member can be maintained, whereby images with a good quality can stably be obtained over a long period of time.

Examples of how to measure physical properties concerning the present invention are shown below.

Measurement of average particle diameter of wax-dispersed non-magnetic toner particles, magnetic carrier and spherical particles:

The average particle diameter of the wax-dispersed non-magnetic toner particles, magnetic carrier and spherical particles may be measured by sieving. An example of how to measure the average particle diameter is described below.

First, about 100 g of a sample is weighed to the figure of 0.1 g. Meanwhile, standard sieves (hereinafter simply "sieves") of 100 meshes to 400 meshes are prepared, and these are overlaid one another in the order of 100, 145, 200, 250, 350 and 400 in size from the top. A saucer is placed at the bottom, and the sample is put in the uppermost sieve, which is then covered up. After it has been covered up, this is sieved by means of a vibrator for 15 minutes at a number of horizontal spinning of 285 plus-minus 6 times per minute and a number of vibration of 150 plus-minus 10 times per minute. After sieving, each sieve is weighed to the figure of 0.1 g, and the sample present in each sieve is weighed. From the weight of the sample weighed for each sieve and the total weight of the sample weighed first, the weight percentage of the sample in each sieve is calculated to two decimals, and then round off to one decimal according to JIS Z8401. Here, as to the sieves, those each having frame size of 200 mm in inner diameter of the upper part from the sieving surface and 45 mm in depth from the top to the sieving surface were used. Also, the total sum of the sample weight in the respective sieves must not be 99% or less of the weight of the whole sample weighed first.

From the results of the above measurement, the average particle diameter is determined according to the following equation.

Average particle diameter ($\mu$m)=1/100×[(residue on 100-mesh sieve)×140+(residue on 145-mesh sieve)×122+(residue on 200-mesh sieve)×90+(residue on 250-mesh sieve)×68+(residue on 350-mesh sieve)×52+(residue on 400-mesh sieve)×38+(all-sieve pass sample quantity)×14]

Measurement of ten-point average roughness and average hill-to-hill interval:

The ten-point average roughness (Rz) and the average hill-to-hill interval (Sm) of the developer-carrying member may preferably be measured with a contact surface profile analyzer (SURFCOADER SE-3300, manufactured by Kosaka Laboratory Ltd.). An advantage of using this measuring instrument is that the ten-point average roughness and average hill-to-hill interval can simultaneously be measured by measurement made once. To give an example of how to measure them, they are measured with the above instrument, setting cut-off value at 0.8 mm, measurement length (length of standard) at 2.5 mm, feed rate at 0.1 mm/second, and magnification at 5,000.

Measurement of magnetization intensity:

The magnetization intensity of the magnetic carrier may preferably be measured with a vibration magnetic-field type magnetic-characteristics autographic recorder BHV-30, manufactured by Riken Denshi K.K. As a specific operation to make measurement with this instrument, an external magnetic field of 7.95775 kA/m is formed, and the magnetization intensity when it is formed is determined by the following method.

To measure the magnetization of the magnetic carrier, a cylindrical plastic container is filled with the magnetic carrier in the state it has well densely been packed. In this state, the magnetic moment is measured, and the actual weight when the sample is put in is measured to determine the magnetization intensity ($Am^2/kg$). Also, the true specific gravity may be measured with, e.g., a dry automatic densitometer ACUPIC 1330 (manufactured by Shimadzu Corporation), and the true specific gravity may be multiplied by the magnetization intensity ($Am^2/kg$) obtained as described above, to determine the magnetization intensity per unit volume.

Measurement of resistivity:

The resistivity of the magnetic carrier may be measured by what is called the tablet method. To show preferred measuring conditions as an example, the resistivity of the magnetic carrier is determined using a sandwich type cell having electrodes of 4 $cm^2$ in measurement area and a gap of 0.4 cm between the electrodes, and by applying a load of 1 kg in weight (about 9.8 N) to one electrode, applying a voltage across the both electrodes as an applied voltage E (V/cm), and measuring the electric current flowing through the circuit.

EXAMPLES

In the present Examples, the developing assembly shown in FIG. 3 was used to study the relationship between the surface roughness of the developer-carrying member and the melt adhesion of toner.

As a two-component developer used in the present Examples, a cyan developer was used which contained wax-dispersed non-magnetic toner particles with an average particle diameter of 7.5 $\mu$m and a magnetic carrier with an average particle diameter of 50 $\mu$m. As the wax-dispersed non-magnetic toner particles, used were those comprised of as the binder resin a hybrid resin component having a polyester unit and a vinyl copolymer unit, as the colorant a copper phthalocyanine pigment, as the organometallic compound an aluminum compound of di-tert-butylsalicylic acid, and as the wax a fatty acid hydrocarbon wax. The organometallic compound was contained in an amount of 6% by weight, and the wax in an amount of 5% by weight, based on the total weight of the wax-dispersed non-magnetic toner particles.

As the magnetic carrier, a resin-coated magnetic carrier was used which was obtained by coating ferrite cores with a silicone resin. The magnetization intensity of this magnetic carrier in a magnetic field of 7.95775 kA/m was 60 to 70 $Am^2/kg$, and the resistivity thereof was $10^7$ to $10^8$ $\Omega\cdot cm$. Both the toner particles and the magnetic carrier were so blended that the former was in a concentration of 7% by weight based on the total weight of the two-component developer to obtain the two-component developer.

As the developer-carrying member, four developer-carrying members produced using different materials and abrasive particles were prepared. As materials for the developer-carrying members, stainless steel (SUS) and aluminum were used. As the abrasive particles, specific-shape (spherical) glass beads (FUJI GLASS BEADS) were used. Stated specifically, #400-mesh specific-shape glass beads (FGB#400), #300-mesh specific-shape glass beads (FGB#300) and #100-mesh specific-shape glass beads (FGB#100) were used.

The above meshes are classified according to the standard of square-mesh standard sieves standardized as sieves for measuring particle size distribution according to JIS Z8810. The #400-mesh beads have an average particle diameter of about 37 $\mu$m; #300-mesh beads, about 50 $\mu$m; and #100-mesh beads, about 100 $\mu$m.

For comparison, a developer-carrying member was also prepared which was obtained by subjecting a stainless-steel cylindrical member to blasting with #400-mesh amorphous alumina particles (ARD#400) used as abrasive particles.

To carry out the blasting in producing the above developer-carrying members, each cylindrical member for the developer-carrying members was rotated at 12 rpm, and a gas (air) containing the abrasive particles was sprayed against it from a position 100 mm distant from the cylindrical member at an air pressure (blasting pressure) of 3 $kg/cm^2$ (about $2.9\times10^5$ Pa) while a blasting nozzle of 7 mm in diameter was made to move in parallel with the axial direction of the cylindrical member. The surface of the cylindrical member was thus subjected to blasting to obtain a rough surface. The cylindrical member surface on which the blasting was completed was cleaned and then dried. By the way, conditions such as the rotational speed, the distance of the blasting nozzle from the cylindrical member, the blasting pressure and so forth were a little changed in accordance with the materials of the cylindrical members.

The two-component developer and developer-carrying members thus obtained were each applied in the developing assembly shown in FIG. 3. Initial M/S (mass per unit area) as the quantity of the two-component developer to be held on the developer-carrying member was set to 25 $mg/cm^2$, and the rotational speed of the developer-carrying member to 500 mm/sec. Under these conditions, the developer-carrying member was blank-rotated for 180 minutes to evaluate the developer-carrying member after blank rotation. To make an evaluation, the extend of contamination of the developer-carrying member surface (melt adhesion of toner), found after the blank rotation, and the transport performance for the developer (variations of M/S, mass per unit area) were examined.

Criteria according to which the extent of contamination (stains) and the developer transport performance were evaluated are shown below. Also, the type of the developer-carrying member used, the ten-point average roughness (Rz), the average hill-to-hill interval (Sm) and the results of evaluation after the blank rotation are shown in Table 1.

TABLE 1

| Type of abrasive particles | Developer-carrying member material | Ten-point average roughness (Rz) (μm) | Av. hill-to-hill interval (Sm) (μm) | Extent of contamination | Developer transport performance after running |
|---|---|---|---|---|---|
| ARD #400 | SUS | 3 | 13 | D | B |
| FGB #400 | SUS | 2.5 | 33 | C | B |
| FGB #400 | aluminum | 8 | 35 | B | A |
| FGB #300 | aluminum | 10 | 42 | B | A |
| FGB #100 | aluminum | 14 | 70 | A | A |

Extent of contamination:
A: No stain is seen on the sleeve surface.
B: Small stains are slightly seen.
C: Contamination has extended, but at such a level of half-and-half with the sleeve ground.
D: Contamination has further extended, and areas having remained a sleeve ground are less than the contaminated areas.
Developer transport performance:
A: The coat of the developer is stable and uniform.
B: The coat is non-uniform.

As can be seen from Table 1, the melt adhesion of toner was seen on the developer-carrying member subjected to amorphous blasting with amorphous glass beads. On the other hand, in the case of the developer-carrying members subjected to specific-shape blasting with specific-shape glass beads, the wax-dispersed non-magnetic toner particles melt-adhering to the developer-carrying member surface were in a smaller quantity than those to the developer-carrying member subjected to the blasting with amorphous glass beads. Also, as a result of image reproduction tested on image-forming apparatus using developing assemblies having these developer-carrying members, the developer-carrying members subjected to the specific-shape blasting were found to have less influence on image quality due to the sleeve contamination than the developer-carrying member subjected to the amorphous blasting.

In order to examine the reason for the above difference produced concerning the melt adhesion of toner, the developer-carrying member surface was observed on a microscope under magnification to find that rough and finely ragged grooves were seen at the developer-carrying member surface subjected to the amorphous blasting and that the wax-dispersed non-magnetic toner particles stood buried in the grooves as having been pressed by the magnetic carrier and so forth. It is presumed that the wax-dispersed non-magnetic toner particles having become movable with difficulty have accumulated heat because of, e.g., their compression to the developer layer thickness control member to come into melt adhesion after use over a long period of time.

On the other hand, grooves (unevenness) which are arc-like in sectional shape as shown in FIGS. 4 and 5 stood formed at the developer-carrying member surface subjected to the specific-shape blasting. It is considered that, since the developer-carrying member surface subjected to the blasting with specific-shape glass beads has less fine unevenness than the surface subjected to the amorphous blasting, the developer-carrying member surface has been made to be contaminated with difficulty by the melt adhesion of the wax-dispersed non-magnetic toner particles.

Subjecting the developer-carrying member surface to the specific-shape blasting with specific-shape glass beads or the like makes the developer-carrying member surface smooth, and can lower the level of sleeve contamination. However, the developer-carrying member surface made smooth may give concern about a possibility of lowering the developer transport performance to make it difficult to supply the developer sufficiently to the image-bearing member. Within the range of studies in the present Examples, any difference appeared in the transport performance at the initial stage. However, in the state the developer decreased in fluidity as a result of running, the developer transport performance was found to be better when the Rz was larger or the particle diameter of glass beads was larger.

In summary, it is seen from the results shown in Table 1 that the occurrence of contamination of the developer-carrying member surface by the toner and the transport performance for the developer may differ depending on (1) the degree of ten-point average roughness (Rz) of the developer-carrying member surface or (2) the measure of particle diameter of abrasive particles. These two points are investigated below.

First, with regard to the above (1), it is seen from Table 1 that, the larger the Rz is, the better the extent of contamination is evaluated (the more the melt adhesion of toner occurs with difficulty) and also the better the developer transport performance is. More specifically, it is considered that, as the difference in height and depth between the hills and dales ascribable to the unevenness of the developer-carrying member surface is large, the frictional force acting between the developer and the developer-carrying member surface has increased to improve the developer transport performance. Also, in the blasting with specific-shape glass beads, the grooves of the developer-carrying member surface are substantially arc-like in sectional shape, and grooves having less fine raggedness and being relatively smooth are formed. Hence, making large the value of ten-point average roughness Rz of the developer-carrying member surface is commonly considered to make the wax-dispersed non-magnetic toner particles catch with ease in the dales of the developer-carrying member surface to accelerate the sleeve contamination. It, however, is considered that, in virtue of the above shape of grooves, the wax-dispersed non-magnetic toner particles may hardly come to melt adhere to the surface without being buried in the grooves.

In addition, from the foregoing viewpoint, detailed studies have been made also including the magnetic carrier and the type of the specific-shape spherical particles. As the result, it has been found that any too large ten-point average roughness may adversely affect the formation of ears of the developer, which are to be formed on the developer-carrying member, and consequently may also adversely affect the images to be formed. This is considered to be caused, for one thing, by the fact that the edges corresponding to the hills of the unevenness of the developer-carrying member surface are very sharp.

From the results of such studies, it has been found to be favorable that the ten-point average roughness Rz of the developer-carrying member surface is, as described previously, within the range of $D/6 \leqq Rz \leqq D/2$ where D is the average particle diameter of the magnetic carrier. As long as the ten-point average roughness Rz is within the above range, the magnetic carrier can well be caught in the unevenness of the developer-carrying member surface, the frictional resistance between the developer and the developer-carrying member can be made higher, and the developer transport performance can be improved without causing any serious contamination of the developer-carrying member surface by the toner.

The degree of ten-point average roughness is also influenced by the materials of the developer-carrying member. As can be seen from Table 1, the ten-point average roughness differs between the developer-carrying member made of stainless steel and the developer-carrying member made of aluminum even when the same abrasive particles (FGB#400) are used. In the evaluation results, too, the developer-carrying member made of stainless steel is unpreferable, whereas the developer-carrying member made of aluminum is preferable. Such a difference in the ten-point average roughness is attributable to the fact that the aluminum has a lower hardness than the stainless steel and is more deeply abradable when subjected to blasting under the same conditions.

Meanwhile, in the developer-carrying members having been subjected to blasting with FGB#400 used as abrasive particles, the one made of stainless steel and the one made of aluminum show substantially the same values in respect of the average hill-to-hill interval. Also, in the developer-carrying members having been subjected to blasting with specific-shape spherical particles, the unevenness having the stated average hill-to-hill interval is formed according to the particle diameters of abrasive particles. It is seen from these facts that the balance of the depth and width of grooves can be adjusted by selecting the type and particle diameter of abrasive particles used and the material (hardness) of the developer-carrying member.

The above (2) is discussed below.

As shown in Table 1, the developer-carrying members made of aluminum have been subjected to blasting with specific-shape spherical particles. To compare how the magnetic carriers stand on the developer-carrying members in the respective cases, in the case when the surface has been subjected to blasting with spherical beads having a smaller particle diameter than the magnetic carrier, magnetic-carrier particles can not come into the innermost part of the arc-like (in sectional shape) grooves of the developer-carrying member surface as shown in FIG. 4, so that gaps are formed between the magnetic-carrier particles and the arc-like grooves. Hence, the magnetic-carrier particles can not firmly catch in the arc-like grooves to tend to come rolling on over the grooves of the developer-carrying member surface. Therefore, the frictional resistance between the developer and the developer-carrying member may lower to show a tendency that the transport performance of the developer-carrying member lowers, as so considered.

On the other hand, in the case when the surface has been subjected to blasting with spherical beads having a larger particle diameter than the magnetic carrier, magnetic-carrier particles can come into the innermost part of the arc-like (in sectional shape) grooves of the developer-carrying member surface as shown in FIG. 5, so that any gaps are not formed between the magnetic-carrier particles and the arc-like grooves. Hence, the magnetic-carrier particles can firmly catch in the arc-like grooves to come rolling on with difficulty over the grooves of the developer-carrying member surface. Therefore, the frictional resistance between the developer and the developer-carrying member comes higher to show a tendency that the transport performance of the developer-carrying member is improved, as so considered.

In addition, since, in the case when the surface has been subjected to blasting with spherical beads having a larger particle diameter than the magnetic carrier, the magnetic-carrier particles can come into the innermost part of the grooves of the developer-carrying member surface, its contact with the magnetic carrier can be maintained even where the wax-dispersed non-magnetic toner particles have adhered to the bottoms of the grooves. Hence, in the course the magnetic carrier is circulated through the interior of the developing assembly, including the surface of the developer-carrying member, the wax-dispersed non-magnetic toner particles adhere to the magnetic carrier and are carried on, and the wax-dispersed non-magnetic toner particles may less remain on the developer-carrying member surface. As the result, any sleeve contamination and any deterioration of transport performance may occur with difficulty.

As a result of detailed studies further made also including the type and so forth of the magnetic carrier, it has been found that any abrasive particles specific-shape spherical particles having too large average particle diameter may make random the ears of the magnetic brush on the developer-carrying member, so that the layer (magnetic brush) of the developer may reflect such irregularities to become uneven to affect images adversely. This is due to the following: When the magnetic carrier makes the rise of ears on the developer-carrying member, the distance between ears may differ depending on the magnetic force of a magnetic field formed, the average particle diameter of the magnetic carrier, the magnetization intensity of the magnetic carrier and so forth. In the case of a magnetic carrier making use of ferrite as the magnetic material, the ears are arranged at intervals corresponding to 10 times the average particle diameter of the magnetic carrier to form the magnetic brush. More specifically, where the average particle diameter of the abrasive particles specific-shape spherical particles is 10 times or more the average particle diameter of the magnetic carrier, the ears of the magnetic brush may come random, and the layer of the developer may reflect such irregularities to become uneven to affect images adversely.

From the results of such studies, it has been found that the abrasive particles spherical particles may have an average particle diameter d of $1D \leqq d \leqq 10D$ where D is the average particle diameter of the magnetic carrier. In the case when the spherical particles have the average particle diameter d not smaller than the average particle diameter D of the magnetic carrier, as stated above, the frictional resistance between the developer and the developer-carrying member can be higher, the transport performance of the developer-carrying member can be improved, and also the sleeve contamination may less occur.

In a case in which, among those shown in Table 1, the developer-carrying member made of aluminum and subjected to blasting with #400-mesh glass beads was instead subjected to blasting with spherical particles whose average particle diameter did not fall under $1D \leqq d \leqq 10D$, improvement was achievable to a certain degree in respect of the developer transport performance, but did not come to a level that there was no problem at all. For example, it showed stable transport performance at the initial stage, but tended to cause problems on the transport performance and so forth during its use over a long period of time.

The Sm is further discussed below. As can be seen from Table 1, the average hill-to-hill interval Sm increases with an increase in the average particle diameter of the spherical particles. The average hill-to-hill interval represents the distance between hills qualitatively. Where this distance is large, the magnetic carrier can come into the innermost part of the grooves with ease as stated previously. It is apparent that, the larger the distance is, the more effective it is in order to prevent the sleeve contamination. Referring to the present Example, from the results of different Sm in the results shown in Table 1, it is seen that the sleeve contamination less occur when the Sm is larger.

As a result of detailed studies further made also including the type and so forth of the magnetic carrier, it has been found that the average hill-to-hill interval Sm may be within the range of $D/3 \leqq Sm \leqq 6D$, and preferably $D/2 \leqq Sm \leqq 3D$, where D is the average particle diameter of the magnetic carrier. If the average hill-to-hill interval Sm is more than 6D, the developer layer thickness control member may have an insufficient developer transport performance to tend to cause problems in practical use. Adjusting the average hill-to-hill interval Sm as described above can make the sleeve contamination occur less.

What is claimed is:

1. A developing assembly comprising:

i) a developer container which holds therein a developer;

ii) a developer-carrying member which is rotatably provided at an opening of said developer container to hold thereon the developer and transport the developer to a developing zone;

iii) a developer layer thickness control member which is disposed in a non-contact state with respect to said developer-carrying member to control a layer thickness of the developer held on said developer-carrying member;

iv) a magnetic-field formation means which is enclosed inside said developer-carrying member and disposed stationarily with respect to said developer container and which has magnetic poles for simultaneously a) drawing up the developer from said developer container to said developer-carrying member and b) forming a magnetic field for controlling the layer thickness of the developer on said developer-carrying member where said developer-carrying member faces said developer layer thickness control member; and v) an agitation means which agitates the developer held in said developer container, wherein the developer is a two-component developer which contains wax-dispersed non-magnetic toner particles and a magnetic carrier, said wax-dispersed, non-magnetic toner particles contain at least a binder resin, a colorant, an organometallic compound and a wax, and have an average particle diameter in a range of 2 $\mu$m to 10 $\mu$m, wherein said developer-carrying member is a member which has been subjected to surface blasting with spherical particles so as to have a surface having a ten-point average roughness Rz in a range of D/6 to D/2, where D is the average particle diameter of the magnetic carrier, and wherein the magnetic carrier has a magnetization intensity in a range of 8 $Am^2/kg$ to 50 $Am^2/kg$ in a magnetic field of 7.95775 kA/m.

2. The developing assembly according to claim 1, wherein said developer container is partitioned with a partition member into a developing chamber positioned at a side of an opening of said developer container and an agitation chamber positioned at an inner-part side with respect to the opening of said developer container, wherein said partition member has openings for passing the developer therethrough, wherein an agitation means is provided in each of said developing chamber and said agitation chamber, and wherein said agitation means blends and agitates the developer in each of said developer chamber and said agitation chamber and at the same time transports the developer from one of said developer chamber and said agitating chamber to the other of said developer chamber and said agitating chamber through the openings of said partition member.

3. The developing assembly according to claim 1, wherein the wax-dispersed non-magnetic toner particles are non-magnetic toner particles produced by a pulverization process.

4. The developing assembly according to claim 1, wherein the magnetic carrier has an average particle diameter in a range of 30 $\mu$m to 80 $\mu$m.

5. The developing assembly according to claim 1, wherein an alternating voltage is applied to said developer-carrying member by an electric-field formation means.

6. The developing assembly according to claim 1, wherein said surface of said developer-carrying member has been roughened by surface blasting with spherical particles after said surface of said developer-carrying member has been polished by diamond polishing.

7. The developing assembly according to claim 1, wherein said surface of said developer-carrying member has been surface-treated by electroless plating after said surface of said developer-carrying member has been roughened by surface blasting with spherical particles.

8. The developing assembly according to claim 1, wherein said surface of said developer-carrying member has an average hill-to-hill interval Sm in a range of D/3 to 6D, where D is the average particle diameter of the magnetic carrier.

9. The developing assembly according to claim 8, wherein said average hill-to-hill interval Sm is in a range of D/2 to 3D.

10. The developing assembly according to claim 1, wherein said spherical particles have an average particle diameter in a range of 1D to 10D, where D is the average particle diameter of the magnetic carrier.

11. The developing assembly according to claim 1, wherein the magnetic carrier comprises a magnetic carrier whose particles have been coated with a resin.

12. The developing assembly according to claim 1, wherein the magnetic carrier has a resistivity in a range of $10^7$ Ω×cm to $10^{15}$ Ω×cm.

13. An image-forming apparatus comprising an image-bearing member, a charging means which charges the image-bearing member electrostatically, an imagewise-exposure means which forms an electrostatic latent image on the image-bearing member thus charged, and a developing assembly which develops the electrostatic latent image by means of a developer into a visible image;

said developing assembly comprising:

i) a developer container which holds therein a developer;

ii) a developer-carrying member which is rotatably provided at an opening of said developer container to hold thereon the developer and transport the developer to a developing zone;

iii) a developer layer thickness control member which is disposed in a non-contact state with respect to said developer-carrying member to control a layer thickness of the developer held on the developer-carrying member;

iv) a magnetic-field formation means which is enclosed inside said developer-carrying member and disposed stationarily with respect to said developer container and which has magnetic poles for simultaneously a) drawing up the developer from said developer container to said developer-carrying member and b) forming a magnetic field for controlling the layer thickness of the developer on said developer-carrying member where said developer-carrying member faces said developer layer thickness control member; and v) an agitation means which agitates the developer held in said developer container, wherein the developer is a two-component developer which contains wax-dispersed non-magnetic toner particles and a magnetic carrier, said wax-dispersed, non-magnetic toner particles contain at least a binder resin, a colorant, an organometallic compound and a wax, and have an average particle diameter in a range of 2 $\mu$m to 10 $\mu$m, wherein said developer-carrying member is a member which has been subjected to surface blasting with spherical particles so as to have a surface having a ten-point average roughness Rz in a range of D/6 to D/2, where D is the average particle diameter of the magnetic carrier, and wherein the magnetic carrier has a magnetization intensity in a range of 8 $Am^2/kg$ to 50 $Am^2/kg$ in a magnetic field of 7.95775 kA/m.

14. The image-forming apparatus according to claim 13, wherein said developing assembly is the developing assembly according to any one of claims 1 to 12.

* * * * *

UNITED STATES PATENT AND TRADEMARK OFFICE

CERTIFICATE OF CORRECTION

PATENT NO. : 6,725,007 B2
DATED : April 20, 2004
INVENTOR(S) : Keiko Igarashi

It is certified that error appears in the above-identified patent and that said Letters Patent is hereby corrected as shown below:

Column 1,
Line 62, “having” should be deleted.

Column 2,
Line 6, “any” should read -- some --; and
Line 48, “to come left behind” should read -- being left behind --.

Column 7,
Line 65, “moves” should read -- move --.

Column 9,
Line 23, “comes” should read -- comes to have --.

Column 11,
Line 40, “to come” should be deleted.

Column 16,
Line 63, “extend” should read -- extent --.

Column 21,
Line 5, “less” should read -- occurs less --; and
Line 6, “occur” should be deleted.

Signed and Sealed this

Seventeenth Day of August, 2004

JON W. DUDAS
*Acting Director of the United States Patent and Trademark Office*